US011234071B2

(12) United States Patent
Wakeland et al.

(10) Patent No.: US 11,234,071 B2
(45) Date of Patent: Jan. 25, 2022

(54) ACOUSTIC DEVICE

(71) Applicant: Bose Corporation, Framingham, MA (US)

(72) Inventors: Ray Scott Wakeland, Marlborough, MA (US); Ryan C. Struzik, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 317 days.

(21) Appl. No.: 16/408,179

(22) Filed: May 9, 2019

(65) Prior Publication Data

US 2020/0359129 A1 Nov. 12, 2020

(51) Int. Cl.
*H04R 3/00* (2006.01)
*H04R 1/28* (2006.01)

(52) U.S. Cl.
CPC ..... *H04R 1/2888* (2013.01); *H04R 1/2803* (2013.01); *H04R 2201/021* (2013.01)

(58) Field of Classification Search
CPC ..... H04R 1/2888; H04R 1/2803; H04R 2201/021
USPC ..... 181/199; 381/74, 111, 117
See application file for complete search history.

(56) References Cited

U.S. PATENT DOCUMENTS 7,688,992 B2 3/2010 Aylward
2011/0044489 A1* 2/2011 Saiki ..... H04R 9/027 381/388
2017/0099548 A1* 4/2017 Schoeffmann ..... H04R 1/288
2018/0167710 A1* 6/2018 Silver ..... H04R 1/1075
2019/0020948 A1 1/2019 Silver et al.
2019/0052954 A1* 2/2019 Rusconi Clerici Beltrami ..... H04R 5/02

FOREIGN PATENT DOCUMENTS

EP 3352478 A 7/2018
EP 3352478 A1 * 7/2018 ..... H04R 7/04
WO 2005/115053 A1 1/2005
WO 2020/072943 A1 4/2020

OTHER PUBLICATIONS

The International Search Report and The Written Opinion of the International Searching Authority dated Aug. 9, 2020 for Application No. PCT/US2020/032076.

* cited by examiner

*Primary Examiner* — Ammar T Hamid
(74) *Attorney, Agent, or Firm* — Brian M. Dingman; Dingman IP Law, PC

(57) ABSTRACT

An acoustic device with an open audio device structure that is configured to be carried on the head or upper torso of a user, and an electro-acoustic transducer carried by the open audio device structure and comprising a flat rectangular diaphragm comprising a front face and a rear face, the diaphragm configured to radiate front acoustic radiation from its front face and into a front acoustic volume that has a first sound-emitting outlet proximate a first corner of the transducer and further configured to radiate rear acoustic radiation from its rear face and into a rear acoustic volume that has a second sound-emitting outlet proximate a second corner of the transducer that is diagonally opposite the first corner.

22 Claims, 3 Drawing Sheets

ACOUSTIC DEVICE

BACKGROUND

This disclosure relates to an electro-acoustic transducer that is adapted to be used in open audio devices.

Open audio devices allow the user to be more aware of the environment, and provide social cues that the wearer is available to interact with others. However, since the acoustic transducer(s) of open audio devices are spaced from the ear and do not confine the sound to the just the ear, open audio devices produce more sound spillage that can be heard by others as compared to on-ear headphones. Spillage can detract from the usefulness and desirability of open audio devices.

SUMMARY

All examples and features mentioned below can be combined in any technically possible way.

In one aspect, an acoustic device includes an open audio device structure that is configured to be carried on the head or upper torso of a user, and an electro-acoustic transducer carried by the open audio device structure and comprising a flat rectangular diaphragm comprising a front face and a rear face, the diaphragm configured to radiate front acoustic radiation from its front face and into a front acoustic volume that has a first sound-emitting outlet proximate a first corner of the transducer and further configured to radiate rear acoustic radiation from its rear face and into a rear acoustic volume that has a second sound-emitting outlet proximate a second corner of the transducer that is diagonally opposite the first corner.

Examples may include one of the above and/or below features, or any combination thereof. The transducer may further include a primary magnet proximate the rear face of the diaphragm, and a magnetic circuit that defines a path for magnetic flux of the primary magnet. The primary magnet may comprise first and second at least partially parallel sides and first and second at least partially parallel ends, and the magnetic circuit may further comprise first and second side magnets, the first side magnet proximate to and spaced from the first side of the primary magnet and the second side magnet proximate to and spaced from the second side of the primary magnet. The magnetic circuit may further comprise first and second end magnets, the first end magnet proximate to and spaced from the first end of the primary magnet and the second end magnet proximate to and spaced from the second end of the primary magnet. The first and second sides of the primary magnet may be parallel to the first and second side magnets along some but not all of lengths of the first and second sides of the primary magnet. The first and second ends of the primary magnet may be parallel to the first and second end magnets along some but not all of lengths of the first and second ends of the primary magnet.

Examples may include one of the above and/or below features, or any combination thereof. The magnetic circuit may define a magnetic circuit gap between the primary magnet and the first and second side magnets and the first and second end magnets. The magnetic circuit gap may extend along some but not all of the first and second sides and the first and second ends of the primary magnet. The primary magnet may have a generally rectangular shape wherein corners of the primary magnet proximate the first and second sound-emitting outlets are each defined by a corner edge that is transverse to both a side and an end of the primary magnet that meet at the corner edge.

Examples may include one of the above and/or below features, or any combination thereof. The primary magnet may define a generally rectangular footprint with sides and ends that have lengths. The first and second sides and the first and second ends of the primary magnet may be shorter than the sides and ends of the footprint. The first and second side magnets and the first and second end magnets may have lengths that are equal to the lengths of the sides and ends of the primary magnet that they are closest to. A first shorter side and a first shorter end of the primary magnet may meet to define a first corner of the primary magnet, and a second shorter side and a second shorter end of the primary magnet may meet to define a second corner of the primary magnet. The first and second corners of the primary magnet may be diagonally opposite one another. The first and second corners of the primary magnet may be proximate different corners of the transducer than the first and second corners of the transducer.

Examples may include one of the above and/or below features, or any combination thereof. The transducer may comprise first and second sides and first and second ends. The first side magnet may be spaced from the first end of the transducer by a first distance. The second side magnet may be spaced from the second end of the transducer by the first distance. The first end magnet may be spaced from the first side of the transducer by a second distance. The second end magnet may be spaced from the second side of the transducer by the second distance. The transducer may have a center, and the first and second side magnets and the first and second end magnets may exhibit central symmetry relative to the center of the transducer.

Examples may include one of the above and/or below features, or any combination thereof. The primary magnet may comprise a rear face spaced farthest from the diaphragm. The magnetic circuit may comprise a rear pole piece proximate the rear face of the primary magnet. The second sound-emitting outlet may comprise a first opening in the rear pole piece. The acoustic device may further comprise a voice coil that defines a perimeter and is configured to move the diaphragm. At least some of the first opening in the rear pole piece may be inside of the voice coil perimeter. The acoustic device may further comprise a second opening in the rear pole piece and that is spaced from the first opening in the rear pole piece.

Examples may include one of the above and/or below features, or any combination thereof. The open audio device structure may be configured to be worn on the user's head. The diaphragm may have a diaphragm radiation axis that is transverse to a side of the head. The open audio device structure may comprise a temple piece of eyeglass headphones. The first sound-emitting outlet may be configured to be close to the user's ear. The second sound-emitting outlet may be configured to be farther from the ear. The first and second sound-emitting outlets may lie along an axis that is configured to overlie an ear of a person wearing the eyeglass headphones.

In another aspect, an acoustic device includes an open audio device structure that is configured to be carried on the head or upper torso of a user, and an electro-acoustic transducer carried by the open audio device structure and comprising a flat rectangular diaphragm comprising a front face and a rear face, the diaphragm configured to radiate front acoustic radiation from its front face and into a front acoustic volume that has a first sound-emitting outlet and further configured to radiate rear acoustic radiation from its rear face and into a rear acoustic volume that has a second sound-emitting outlet. The transducer further comprises a primary magnet proximate the rear face of the diaphragm, and a magnetic circuit that defines a path for magnetic flux of the primary magnet, wherein the primary magnet comprises a rear face spaced farthest from the diaphragm, and wherein the magnetic circuit comprises a rear pole piece proximate the rear face of the primary magnet, and wherein the second sound-emitting outlet comprises a first opening in the rear pole piece and the rear pole piece comprises a second opening, wherein the transducer has an area and the first and second openings each comprise at least about 4% of the transducer area.

Examples may include one of the above and/or below features, or any combination thereof. The transducer may have two halves. The first and second openings may both be in the same half of the transducer. The transducer may have first and second diagonally opposite corners. The first opening may be proximate the first corner and the second opening may be proximate the second corner. The first and second openings may each comprise no more than about 12% of the transducer area.

DETAILED DESCRIPTION

Figure 1:
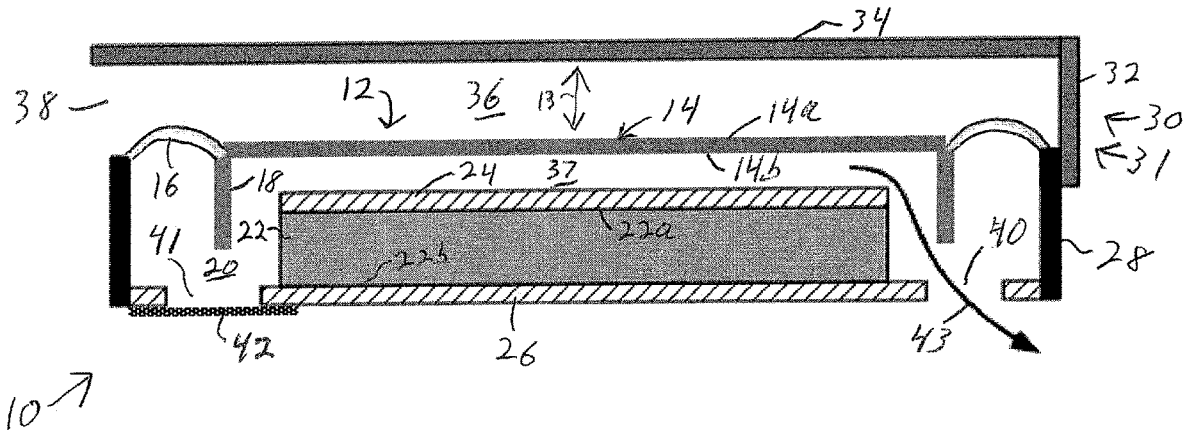
FIG. 1 is partial, schematic, cross-sectional view of an acoustic device.

The electro-acoustic transducer for the acoustic device of the present disclosure is very thin yet is able to exhibit dipole-like acoustic properties where sound in the far field is canceled. The transducer diaphragm is preferably but not necessarily flat or nearly flat. The transducer has two spaced sound-emitting openings. One opening receives sound from the front face of the transducer diaphragm. The other opening receives sound from the rear face of the diaphragm. Because the sound is emitted from both faces of the diaphragm, the sound is inherently out of phase. The sound from the openings will thus tend to cancel in the far field, resulting in dipole-like behavior. The transducer is part of an acoustic device (e.g., an open audio device) that has an open-audio device structure that is configured to be carried on the head or upper torso and locates and orients the transducer such that one transducer opening is closer to the ear than is the other transducer opening. Sound from the opening that is closer to the ear is not completely canceled by sound from the other opening because the other opening is more distant. The transducer can thus be used in a low-spillage open audio device.

An electro-acoustic transducer includes an acoustic element (e.g., a diaphragm) that emits front-side acoustic radiation from its front side and emits rear-side acoustic radiation from its rear side. The diaphragm is preferably but not necessarily flat. This helps to keep the transducer thin. A housing or other structure directs the front-side acoustic radiation and the rear-side acoustic radiation. A plurality of sound-emitting vents in this structure allow sound to leave the structure. The electro-acoustic transducer is able to achieve a greater ratio of sound pressure delivered to the ear to spilled sound, as compared to a traditional thin transducer with a flat diaphragm.

This disclosure describes a type of open audio device with one or more electro-acoustic transducers that are located off of the ear. A headphone refers to a device that typically fits around, on, or in an ear and that radiates acoustic energy into the ear canal. Headphones are sometimes referred to as earphones, earpieces, headsets, earbuds, or sport headphones, and can be wired or wireless. A headphone includes an electro-acoustic transducer (driver) to transduce audio signals to acoustic energy. The acoustic driver may or may not be housed in an earcup. The figures and descriptions following show a single open audio device. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around the ear or on the ear or off the ear headphone, the headphone may include a headband and at least one housing or other structure that is arranged to sit on or over or proximate an ear of the user. The headband can be collapsible or foldable, and can be made of multiple parts. Some headbands include a slider, which may be positioned internal to the headband, that provides for any desired translation of the housing. Some headphones include a yoke pivotally mounted to the headband, with the housing pivotally mounted to the yoke, to provide for any desired rotation of the housing.

An open audio device includes but is not limited to off-ear headphones (i.e., devices that have one or more electro-acoustic transducers that are coupled to the head but do not occlude the ear canal opening), and audio devices carried by the upper torso, e.g., the shoulder region. In the description that follows the open audio device is depicted as an off-ear headphone, but that is not a limitation of the disclosure as the electro-acoustic transducer can be used in any device that is configured to deliver sound to one or both ears of the wearer where there are no ear cups and no ear buds.

Exemplary acoustic device 10 is depicted in FIG. 1, which is a schematic longitudinal cross-section. Acoustic device 10 is typically but not necessarily generally rectangular and includes electro-acoustic transducer 12 which includes flat diaphragm 14 with front face 14*a* and opposed rear face 14*b*. Diaphragm 14 is located within housing 31. Housing 31 is mostly closed, except for a number of sound-emitting openings or vents. The housing and its vents are constructed and arranged to achieve a desired sound pressure level (SPL) delivery to a particular location, while minimizing sound that is spilled to the environment. These results make acoustic device 10 an effective acoustic device for an open audio device such as an off-ear headphone. However, this disclosure is not limited to off-ear headphones, as the electro-acoustic transducer is also effective in other uses such as body-worn personal audio devices, for example.

Housing 31 comprises a sound-directing structure 30 comprising housing front wall 34 and housing end wall 32. Housing 31 further comprises basket 28 and rear pole piece 26. Housing 31 defines an acoustic radiator front volume 36, and an acoustic radiator rear volume 37. Diaphragm 14 is configured to be moved up and down in the direction of arrow 13 (which may also be considered the diaphragm radiation axis) and thus radiates sound pressure into both volume 36 and volume 37, the sound pressure to the two different volumes being out of phase. Housing 31 thus directs both the front side acoustic radiation and the rear side acoustic radiation. Housing 31 comprises two (and in some cases three, or more) sound-emitting openings in this non-limiting example. Front opening 38, which could optionally be covered by a screen to prevent ingress of dust or foreign matter, is in or proximate one corner of housing 31. Rear opening 40 is in or proximate a diagonally opposite corner of housing 31 and so is as far from front opening 38 as is possible given the size and generally rectangular shape of housing 31. The general path of sound from volume 37 through opening 40 is indicated by arrow 43. Opening 40 could be covered by a screen to prevent ingress of dust or foreign matter. One of openings 38 and 40 should be close to the ear and the other as far as possible from the ear. Second rear opening 41 (when present) would typically be covered by a resistive screen 42, such as a 46 Ray1 polymer screen made by Saati Americas Corp., with a location in Fountain Inn, S.C., USA; the acoustic impedance of the screen would be selected to achieve a desired resistance in light of the details of the rear port design, the area of opening 41, and the desired impedance of opening 41 to damp resonances in rear cavity 37. When an opening is referred to as "resistive", it means that the resistive component is dominant.

A front opening and a rear opening radiate sound to the same acoustic space (e.g., see space 91, FIG. 3) outside of housing 31 in a manner that can be equated to an acoustic dipole that is defined by opening 38 and opening 40. An ideal acoustic dipole exhibits a polar response that consists of two lobes, with equal radiation forwards and backwards along a dipole radiation axis, and no radiation (i.e., a null) perpendicular to the axis. Acoustic device 10 as a whole exhibits acoustic characteristics of an approximate dipole (i.e., is dipole-like).

One or more openings on the front side of the transducer and one or more openings on the rear side of the transducer create dipole radiation from the transducer. When used in an open personal near-field audio system (such as with off-ear headphones, eyeglass headphones, or a torso-worn device), there are two main acoustic challenges that are addressed by the acoustic device of the present disclosure. Headphones or other personal audio devices should deliver sufficient SPL to the ear, while at the same time minimizing spillage to the environment. For applications where the sound source is placed near but not covering an ear, what is desired is high SPL at the ear and low SPL spilled to bystanders (i.e., low SPL farther from the source). The SPL at the ear is a function of how close the front and back sides of the dipole are to the ear canal. Having one dipole source close to the ear and the other far away causes higher SPL at the ear for a given driver volume displacement.

As described above, one non-limiting manner of arranging the transducer such that one dipole source opening is located near the ear and another dipole source opening is located farther from the ear is to locate the openings in or very near the diagonally opposite ends of the housing. Another goal of the transducer is for it to be thin so that it can be carried near the ear but not be overly obtrusive. As depicted in FIG. 1, flat diaphragm 14 can be configured to move toward and away from the front and rear housing walls 34 and 26, respectively. Configuring housing 31 such that the distance between the centers of dipole source openings 38 and 40 is greater than the distance between front and rear housing walls 34 and 26 on a line normal to diaphragm front face 14*a* helps to accomplish a thin transducer with its dipole source openings spaced far enough apart to advantageously cancel sound in the far field.

Transducer 12 also includes flexible structure 16 (which may be but need not be a roll) that supports diaphragm 14 such that the diaphragm can move relative to housing 31. Primary magnet 22 is proximate to rear diaphragm face 14*b*. Magnet 22 may have but need not have flat top and bottom surfaces. A magnetic circuit defines a path for magnetic flux from magnet 22 such that the flux properly interacts with voice coil 18. The magnetic circuit comprises front pole piece 24 which may be a flat plate that sits on the top surface 22*a* of magnet 22, as shown, and rear pole piece 26 which may be a flat plate that sits against the bottom face 22*b* of magnet 22, as shown. Plate 26 may extend beyond the perimeter of magnet 22 so that plate 26 can form the rear wall of housing 31. Voice coil 18 is located in magnetic circuit gap 20 and is exposed to magnetic flux so that it moves the diaphragm up and down. Housing 31 also includes basket 28 that has opposed ends that surround the magnetic circuit and the diaphragm. End wall 32 of structure 30 is coupled to basket 28 and supports front wall 34 that overlies and is spaced from diaphragm 14 to define front volume 36 as well as front opening 38.

Some of the electro-acoustic transducers shown in the figures are rectangular, and typically include four small magnets on the outside of the voice coil. In these transducers a central, positively polarized primary magnet is surround by four oppositely polarized secondary magnets that are part of the magnetic circuit of the transducer. There would typically but not necessarily be one secondary magnet spaced from and parallel to at least some of each of the four sides of the primary magnet. The diaphragm is rectangular and flat. A problem with this arrangement for open audio devices (in which sound from both faces of the diaphragm is used) is that the flow of air in the rear acoustic space behind the diaphragm is highly restricted, and may not flow out the back or rear of the transducer with the appropriate phase to cancel far-field sound from the front of the diaphragm. All the air displaced at the rear of the diaphragm must flow through the small gaps around the voice coil. These gaps restrict the flow, potentially to an extent that the transducer does not act sufficiently like a dipole to be useful to cancel far-field sound.

In an open audio device it is desirable for the sound from one side of the diaphragm to exit from a "nozzle" close to the ear, and the sound from the other side of the diaphragm to exit much farther from the ear, at the other end of the transducer. This creates something like a dipole, with good far-field sound cancellation. Where air flow from the rear side of the diaphragm is restricted by the voice coil gap, the dipole behavior of the transducer is limited.

The dipole behavior of such transducers is improved in this disclosure by arranging the transducer such that sound from both sides of the diaphragm can exit the transducer such that, at least in approximation, the sound from the two sides of the transducer is out of phase and exits the transducer from openings that are far enough apart such that sound is not cancelled before it reaches the ear canal.

Another issue of concern with open audio devices that are worn on the head (such as eyeglass headphones) is that the transducer should be as thin as possible. Thin transducers can better fit into eyeglasses (e.g., into the right and left temple pieces) and other carriers that are worn on the head, and are less obtrusive and thus more desirable. Adding structure around the transducer to direct the front and/or back acoustic radiation can help achieve the goals of dipole behavior described above. However, this structure may add to the thickness and/or size of the transducer and so may not be desirable. Alternative transducer arrangements that can accomplish the desired behaviors are disclosed herein.

Figure 2A:
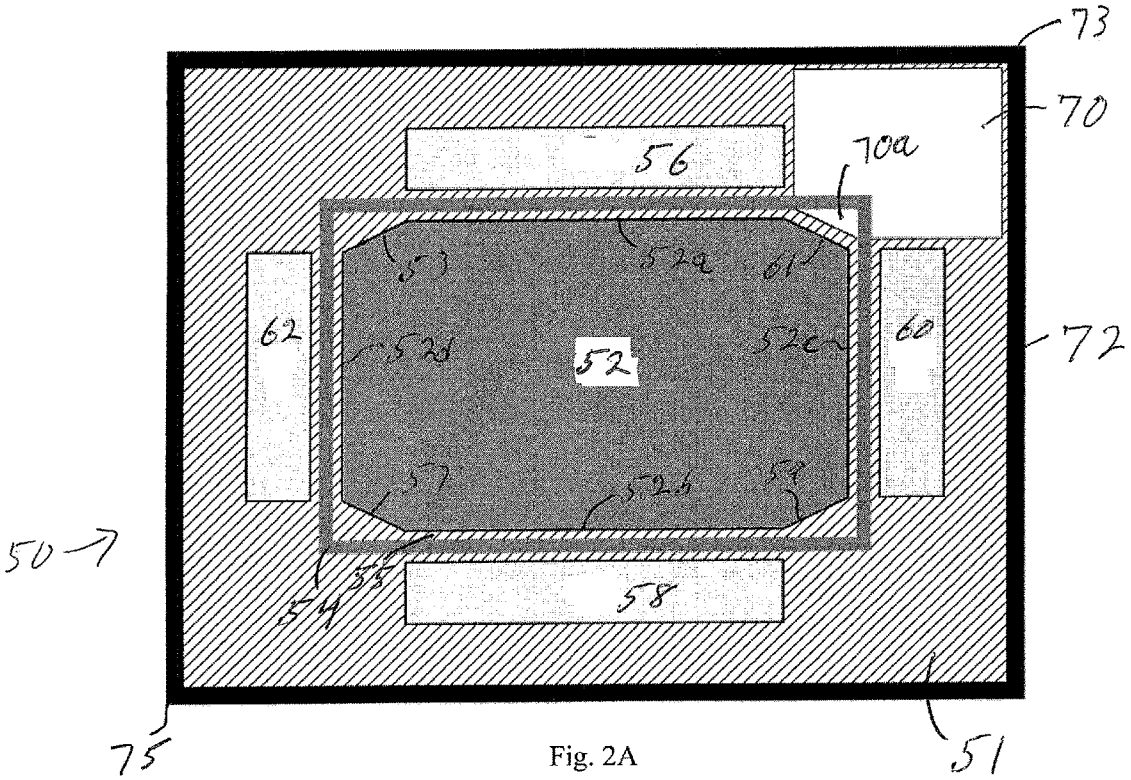
FIG. 2A is a partial, schematic view of a transducer for an acoustic device.

FIG. 2A is a partial top view of generally rectangular transducer 50. The front plate, diaphragm, roll, and top part of the housing are removed so that the magnetic circuit can be seen. Primary magnet 52 is generally rectangular, with parallel sides 52*a* and 52*b*, and parallel ends 52*c* and 52*d* that are orthogonal to the sides. Corners 53, 57, 59, and 61, are pulled back from what would be the squared-off corners of a rectangle, such that the corners are each transverse to both a side and an adjacent end. Voice coil 54 is located in magnetic circuit gap 55. Secondary magnets 56, 58, 60, and 62 are close to and parallel to the straight parts of magnet sides 52*a*, 52*b*, 52*c*, and 52*d*, respectively, as shown. Each of the five magnets are symmetrical with respect to the center of the transducer, so that no moments are created about the central axis, which prevents undesired rocking of the diaphragm. Rear plate 51 and surround (e.g., basket) 72 are shown. Transducer 50 has diagonally opposite corners 73 and 75.

In order to provide sound-emitting openings that are located as far apart as possible, it is desirable to locate the openings at diagonally opposite corners, such as corners 73 and 75. In order to create a back plate opening (to emit sound from the rear acoustic volume) that is large enough and positioned such that the sound emitted from it is of opposite phase to the front-side sound and flow noise and distortion are reduced, it is helpful to create opening 70 in rear plate 51, where opening 70 is close to corner 73. In this non-limiting example where magnet corner 61 is pulled back, portion 70*a* of opening 70 can be located inside the perimeter of voice coil 54; this allows some of the necessary airflow through opening 70 to not have to move past the voice coil, which may help to achieve a desired airflow level and maintain the desired opposite phase relationship with the front-side radiation. In order to avoid the creation of diaphragm rocking motions, it may be helpful to remove a second portion of rear plate 51 that is about equal in size to opening 70 and located near opposite corner 75. This is not shown in FIG. 2A but is further described below in conjunction with FIG. 4.

Figure 2B:
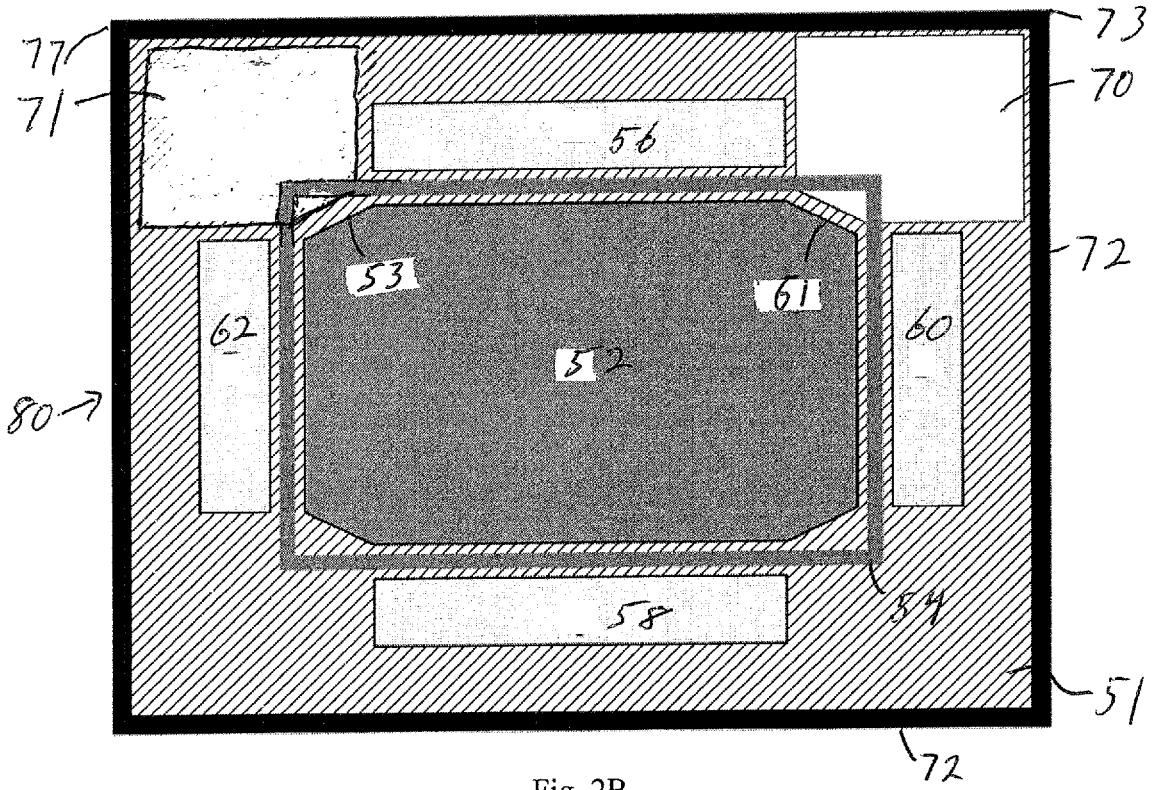
FIG. 2B is a partial, schematic view of a transducer for an acoustic device.

FIG. 2B illustrates transducer 80 which is identical to transducer 50, FIG. 2A, except includes second large opening 71 in back plate 51, proximate corner 77 that is opposite corner 73, but not diagonally opposite. Opening 71 may or may not be the same size and/or shape as opening 70. Openings 70 and 71 are preferably but not necessarily in the same half of the transducer, and preferably but not necessarily lie along the same side of the transducer. Alternatively, openings 70 and 71 could be diagonally opposite one another.

One of openings 70 and 71 is used to conduct sound pressure from the back side of the diaphragm to the atmosphere. The openings should be large enough to achieve this purpose while not being so large that they have a detrimental effect on transducer performance. The flow velocity though the openings is the volume velocity produced by the transducer divided by the area of the openings. Since the maximum volume velocity that the transducer can produce scales with the size of the transducer, the minimum area of the openings needed to keep the flow velocity below a level that creates and unacceptable amount of noise also scales with transducer size. Over the range of transducer sizes expected to be of use in head-worn devices, it is adequate to express the minimum needed area of the openings as a percentage of transducer area.

Preferably but not necessarily each of openings 70 and 71 includes at least about 4% of the total transducer area (i.e., the total area inside of surround 72). Openings of at least about 4% are expected to be sufficient to inhibit substantial noise caused by airflow through the opening due to motion of the transducer diaphragm. Openings of at least about 4% are also expected to result in low enough impedance such that the rear sound exiting through the opening is of substantially opposite phase to the front sound. The opening thus maintains the dipole performance that leads to substantial far-field cancellation.

Openings 70 and 71 are in the back plate of the transducer motor. The back plate contributes significantly to guidance of the transducer magnetic field that is necessary for acceptable performance of the transducer motor. The maximum combined area of openings 70 and 71 should be such that there is not an unacceptable detrimental effect on transducer performance. The maximum area thus may at least in part depend on the necessary qualities of the transducer for the particular application of the transducer. As one non-limiting example, for a transducer for eyeglass headphones, it is expected that the maximum area of each of openings 70 and 71 is about 12% of the total transducer area.

The arrangement of transducer 80, with two large rear-side sound-emitting openings in the rear plate, can achieve certain advantages. For one, when the transducer is used in eyeglass headphones, where each temple piece of the eyeglass includes a transducer, and where the front sound outlets (the nozzles) are located on the inside of the temple piece (facing the head and the ear), a single acoustic device or driver can be used for both the right and left temple pieces. In each case, one of openings 70 and 71 would be used as the rear opening of the dipole, and the second opening would either be effectively closed (e.g., with a high-impedance scrim) or it could be configured to have a desired impedance such that it was effective to damp standing waves in the rear acoustic cavity. The desired impedance could be accomplished in one non-limiting example with a resistive scrim covering the second rear opening.

It should be understood that both FIGS. 2A and 2B are schematic. Also, to clarify aspects shown in FIGS. 2A and 2B, the drawings do not include the diaphragm or the front pole piece. This allows the relationship of the four sides of the primary magnet to the secondary magnets and the rear opening(s) to be visible in the figure.

It should also be understood that by "rectangular" we mean generally rectangular. When applied to the diaphragm and the primary and secondary magnets, by generally rectangular we mean they may include such features as shortened, pulled-back or radiused corners, or small indentations on the perimeter to assist in assembly or provide clearances to eliminate interference with other parts of the transducer during operation. It should also be understood that by "flat" we mean generally flat. When applied to the diaphragm, by generally flat we mean that a diaphragm might include ribs or variations in thickness in order to add stiffness or modify modal breakup behavior, but still be "flat" overall.

Figure 3:
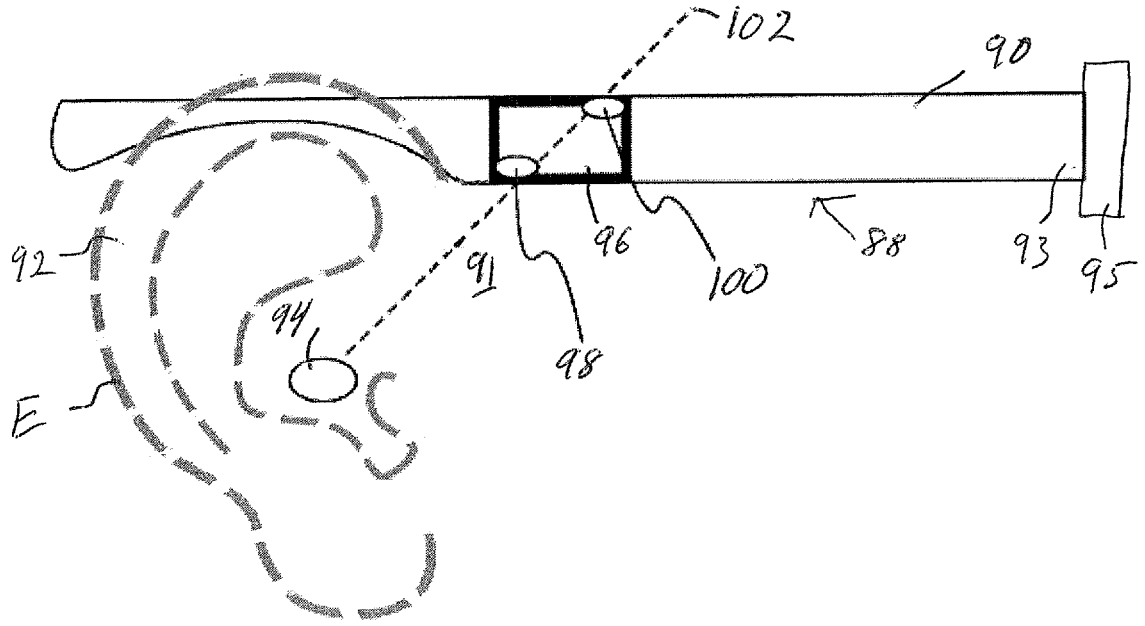
FIG. 3 is a partial, schematic side view of an acoustic device near an ear of a user.

In some non-limiting examples herein, the electro-acoustic transducer is used to deliver sound to an ear of a user, for example as part of a headphone or another type of open audio device. An exemplary eyeglass open audio device 88 is partially depicted in FIG. 3. Electro-acoustic transducer 96 is positioned to deliver sound to ear canal opening 94 of right ear E with pinna 92. Transducer 96 is carried by eyeglass right temple piece 90 such that the acoustic radiator is held near but not covering the ear. Front end 93 of temple piece 90 is connected to eyeglass bridge 95, as is normally the case with eyeglasses. An alternative to a temple piece could be a headband or other support structure that was carried by the head. In order to keep the thickness of the housing as small as possible, the direction of motion of the diaphragm (i.e., its radiation axis, as depicted by arrow 13, FIG. 1) is preferably transverse to (in one non-limiting example essentially perpendicular to) the side of the head. In FIG. 3, transducer 96 may be oriented such that its rear wall (e.g., rear pole piece 26, FIG. 1) is against or very close to the cheek and front wall 34 faces out, away from the head. Transducer 96 could be flipped around, with front wall 34 closest to the cheek. One of the two end sound emitting openings 38 and 40 is close to ear canal opening 94 and the other is spaced farther from the ear canal. The front housing wall (e.g., wall 34, FIG. 1) could be the inside of the temple piece. One opening (e.g., the front opening) could be accomplished with an opening of appropriate size and location in the temple piece. Other details of eyeglass open audio device 88 that are not important to an understanding of this disclosure (such as the left temple piece, not shown, that would also be connected to eyeglass bridge 95) are not included, for the sake of simplicity.

In the non-limiting example of FIG. 3, front opening 98 of transducer 96 is closer to ear canal 94 than is back opening 100. Also, opening 98 is farther from bridge 95 than is opening 100. All openings radiate into acoustic space 91 that is around the ear and the side of the head. Opening 98 is preferably located anteriorly of pinna 92 and the tragus, and close to the ear canal. Sound exiting through opening 98 is thus not blocked by or substantially impacted by the structure of the ear before the sound reaches the ear canal. Opening 100 is farther from the ear. The areas of openings 98 and 100 should be large enough such that there is minimal flow noise due to turbulence induced by high flow velocity. Also, it is desired but not necessary that openings 98 and 100 lie along, or generally along, axis 102 that also overlies ear E, and preferably intersects or comes close to ear canal opening 94 (as shown). Advantages of this opening orientation include that this places the front opening as close as possible to the ear and the back opening as far as possible from the ear, so there is less cancellation at the ear. Also, since the acoustic field of the dipole is strongest along an axis that runs through both openings, on-axis openings result in the strongest possible acoustic field at the ear; openings off-axis move the ear canal opening closer to a dipole null and so reduce the sound that is heard by the user. Note that this arrangement of openings is illustrative of principles herein and is not limiting of the disclosure, as the location, size, shape, impedance, and quantity of openings can be varied to achieve particular sound-delivery objectives, as would be apparent to one skilled in the art.

Figure 4:
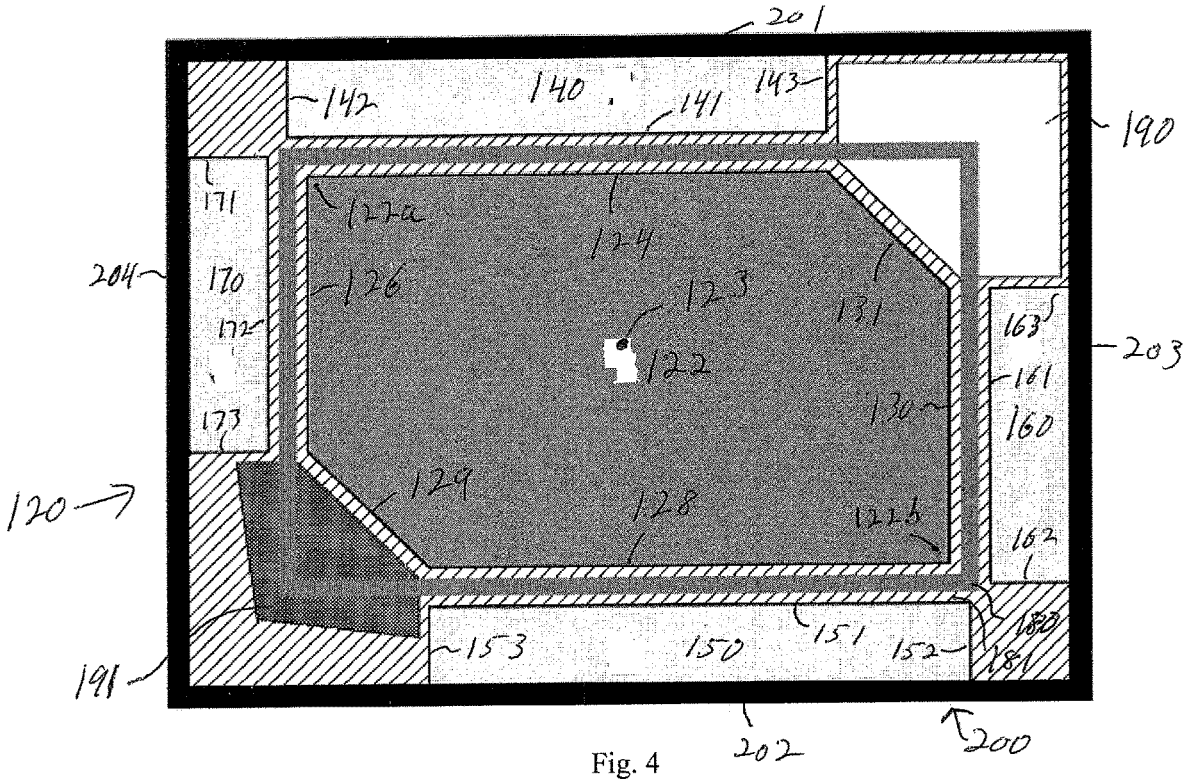
FIG. 4 is a partial, schematic view of a transducer for an acoustic device.

Transducer 120, FIG. 4, is configured to achieve sufficient rear side air flow in a transducer that has a smaller footprint than transducer 50, FIG. 2A. As with FIGS. 2A and 2B, the diaphragm and the front part of the housing are not shown, simply for clarity of illustration. Generally rectangular primary magnet 122 includes sides 124 and 128 and ends 126 and 130, with retracted or cut-off opposite corners 131 and 129. Side 124 and end 126 meet to define primary magnet corner 122*a*. Side 128 and end 130 meet to define primary magnet corner 122*b*. The secondary (side) magnets 140, 150, 170, and 160 that are adjacent to the sides and ends have a length that is equal to the length of the respective sides and ends of the primary magnet. Also, the magnetic structure comprising the five magnets exhibits central symmetry relative to the center 123 of the transducer. The symmetry is in part accomplished by desired spacing of the four secondary magnets relative to surround 200, and wherein primary magnet 122 and voice coil 180 (which lies in magnetic circuit gap 181) are symmetric and centered on center 123. The secondary magnet spacing is such that end 142 of magnet 140 is spaced from side 204 of surround 200 by the same amount as is end 152 of magnet 150 from opposite side 203 of surround 200. Since magnets 140 and 150 are the same length, this means that ends 143 and 153 are also equally spaced from surround sides 203 and 204, respectively. Likewise, ends 162 and 171 of magnets 160 and 170 are equally spaced from surround sides 202 and 201, respectively, and ends 173 and 163 are equally spaced from surround sides 202 and 201, respectively.

Symmetry is also bolstered by including two diagonally-opposite back side openings 190 and 191 that each have approximately the same area and are each located close to a corner of the acoustic transducer. Openings 190 and 191 may be on different corners of the transducer than are primary magnet corners 122*a* and 122*b*. Openings 190 and 191 preferably but not necessarily are at least partially inside the perimeter of voice coil 180. Accordingly, air does not need to flow through gap 181 and around the voice coil in order to exit through an opening. Second opening 191 can be configured to help damp acoustic resonances in the back acoustic cavity, This can be accomplished by covering opening 191 with a resistive scrim that results in a desired acoustic impedance.

Figure 5:
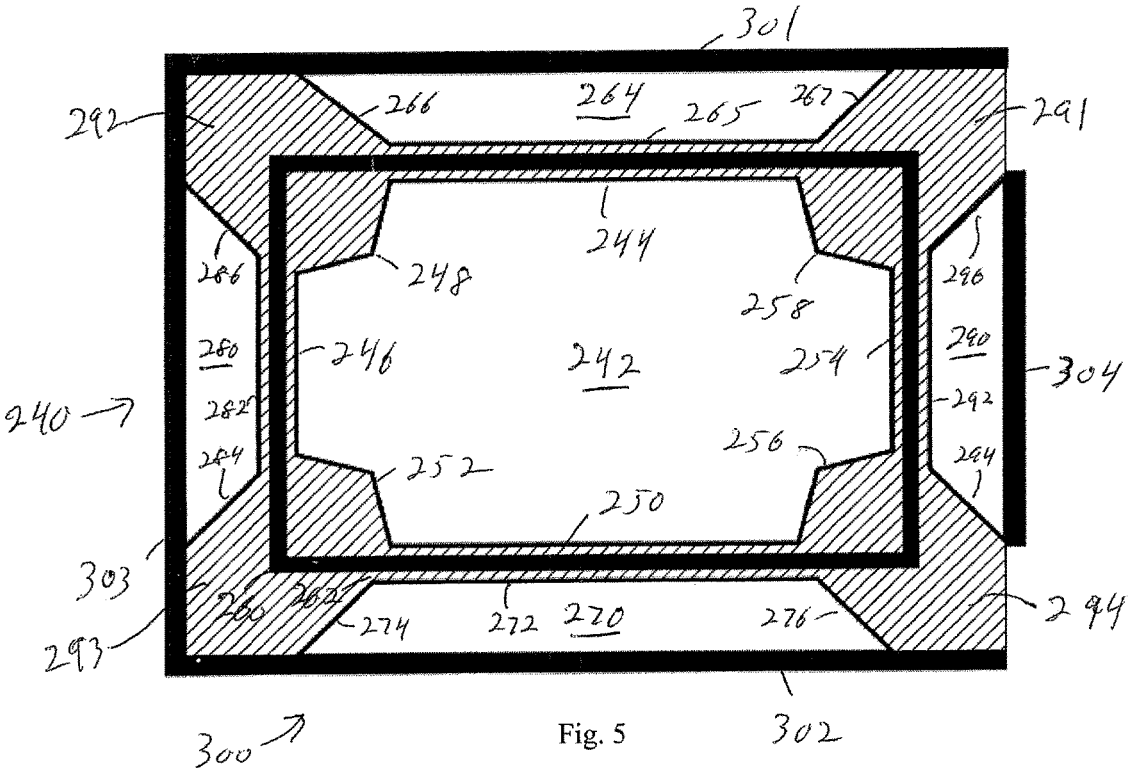
FIG. 5 is a partial, schematic view of a transducer for an acoustic device.

FIG. 5 illustrates another exemplary transducer 240 with a generally rectangular primary magnet 242, voice coil 260 in voice coil gap 262, and four secondary side and end magnets 264, 270, 280, and 290. In this example, space between the voice coil and the magnets, added to increase sound pressure flow as described above, is created by modifying the shapes of one or more of the magnets, for example to remove the corners of any one of or all five magnets. For example, corners 248, 252, 256, and 258 of primary magnet 242 have been pulled back so the corners are not squared off, leaving more space between the corners of the magnet and the voice coil. Also, adjacent sides of the secondary magnets can be pared back as shown, which also opens up the free spaces at the four corners of the acoustic device. For example, sides 286 and 266 of magnets 280 and 264 are shortened and angled rather than perpendicular to interior sides 282 and 265. Likewise, sides 284 and 274 of magnets 280 and 270 are shortened and angled rather than perpendicular to interior sides 282 and 272. Likewise, sides 276 and 294 of magnets 270 and 290 are shortened and angled rather than perpendicular to interior sides 272 and 292. Likewise, sides 296 and 267 of magnets 290 and 264 are shortened and angled rather than perpendicular to interior sides 292 and 265. The reconfiguration of nominally rectangular magnets creates wide spaces (e.g., spaces 291-294) through which sound pressure can move into one or more rear-side sound-emitting outlets (not shown) in back plate 294.

A number of implementations have been described. Nevertheless, it will be understood that additional modifications may be made without departing from the scope of the inventive concepts described herein, and, accordingly, other examples are within the scope of the following claims.

What is claimed is:

1. An acoustic device, comprising:

an open audio device structure that is configured to be carried on the head or upper torso of a user; and an electro-acoustic transducer carried by the open audio device structure and comprising a flat rectangular diaphragm comprising a front face and a rear face, the diaphragm configured to radiate front acoustic radiation from its front face and into a front acoustic volume that has a first sound-emitting outlet proximate a first corner of the transducer and further configured to radiate rear acoustic radiation from its rear face and into a rear acoustic volume that has a second sound-emitting outlet proximate a second corner of the transducer that is diagonally opposite the first corner;

wherein the transducer further comprises a primary magnet proximate the rear face of the diaphragm and a magnetic circuit that defines a path for magnetic flux of the primary magnet, wherein the primary magnet comprises a rear face spaced farthest from the diaphragm, wherein the magnetic circuit comprises a rear pole piece proximate the rear face of the primary magnet, wherein the second sound-emitting outlet comprises a first opening in the rear pole piece, and further comprising a second opening in the rear pole piece and that is spaced from the first opening in the rear pole piece.

2. The acoustic device of claim 1, wherein the primary magnet comprises first and second at least partially parallel sides and first and second at least partially parallel ends, and wherein the magnetic circuit further comprises first and second side magnets, the first side magnet proximate to and spaced from the first side of the primary magnet and the second side magnet proximate to and spaced from the second side of the primary magnet, and first and second end magnets, the first end magnet proximate to and spaced from the first end of the primary magnet and the second end magnet proximate to and spaced from the second end of the primary magnet.

3. The acoustic device of claim 2, wherein the first and second sides of the primary magnet are parallel to the first and second side magnets along some but not all of lengths of the first and second sides of the primary magnet.

4. The acoustic device of claim 2, wherein the first and second ends of the primary magnet are parallel to the first and second end magnets along some but not all of lengths of the first and second ends of the primary magnet.

5. The acoustic device of claim 2, wherein the magnetic circuit defines a magnetic circuit gap between the primary magnet and the first and second side magnets and the first and second end magnets.

6. The acoustic device of claim 5, wherein the magnetic circuit gap extends along some but not all of the first and second sides and the first and second ends of the primary magnet.

7. The acoustic device of claim 2, wherein the primary magnet has a generally rectangular shape, wherein corners of the primary magnet proximate the first and second sound-emitting outlets are each defined by a corner edge that is transverse to both a side and an end of the primary magnet that meet at the corner edge.

8. The acoustic device of claim 2, wherein the primary magnet defines a generally rectangular footprint with sides and ends that have lengths, and wherein the first and second sides and the first and second ends of the primary magnet are shorter than the sides and ends of the footprint.

9. The acoustic device of claim 8, wherein the first and second side magnets and the first and second end magnets have lengths that are equal to the lengths of the sides and ends of the primary magnet that they are closest to.

10. The acoustic device of claim 8, wherein a first shorter side and a first shorter end of the primary magnet meet to define a first corner of the primary magnet and a second shorter side and a second shorter end of the primary magnet meet to define a second corner of the primary magnet, wherein the first and second corners of the primary magnet are diagonally opposite one another.

11. The acoustic device of claim 10, wherein the first and second corners of the primary magnet are proximate different corners of the transducer than the first and second corners of the transducer.

12. The acoustic device of claim 2, wherein the transducer comprises first and second sides and first and second ends, and wherein the first side magnet is spaced from the first end of the transducer by a first distance, the second side magnet is spaced from the second end of the transducer by the first distance, the first end magnet is spaced from the first side of the transducer by a second distance, the second end magnet is spaced from the second side of the transducer by the second distance.

13. The acoustic device of claim 2, wherein the transducer has a center, and wherein the first and second side magnets and the first and second end magnets exhibit central symmetry relative to the center of the transducer.

14. The acoustic device of claim 1, further comprising a voice coil that defines a perimeter and is configured to move the diaphragm, and wherein at least some of the first opening in the rear pole piece is inside of the voice coil perimeter.

15. The acoustic device of claim 1, wherein the open audio device structure is configured to be worn on the user's head, and wherein the diaphragm has a diaphragm radiation axis that is transverse to a side of the head.

16. The acoustic device of claim 15, wherein the open audio device structure comprises a temple piece of eyeglass headphones, and wherein the first sound-emitting outlet is configured to be close to the user's ear and the second sound-emitting outlet is configured to be farther from the ear.

17. The acoustic device of claim 16, wherein the first and second sound-emitting outlets lie along an axis that is configured to overlie an ear of a person wearing the eyeglass headphones.

18. An acoustic device, comprising:

an open audio device structure that is configured to be carried on the head or upper torso of a user; and an electro-acoustic transducer carried by the open audio device structure and comprising a flat rectangular diaphragm comprising a front face and a rear face, the diaphragm configured to radiate front acoustic radiation from its front face and into a front acoustic volume that has a first sound-emitting outlet and further configured to radiate rear acoustic radiation from its rear face and into a rear acoustic volume that has a second sound-emitting outlet;

wherein the transducer further comprises a primary magnet proximate the rear face of the diaphragm, and a magnetic circuit that defines a path for magnetic flux of the primary magnet, wherein the primary magnet comprises a rear face spaced farthest from the diaphragm, and wherein the magnetic circuit comprises a rear pole piece proximate the rear face of the primary magnet, and wherein the second sound-emitting outlet comprises a first opening in the rear pole piece and the rear pole piece comprises a second opening, wherein the transducer has an area and the first and second openings each comprise at least about 4% of the transducer area.

19. The acoustic device of claim 18, wherein the transducer has two halves, and wherein the first and second openings are both in the same half of the transducer.

20. The acoustic device of claim 18, wherein the transducer has first and second diagonally opposite corners, and wherein the first opening is proximate the first corner and the second opening is proximate the second corner.

21. The acoustic device of claim 20, wherein the first and second openings each comprise no more than about 12% of the transducer area.

22. An acoustic device, comprising:

an open audio device structure that is configured to be carried on the head or upper torso of a user; and an electro-acoustic transducer carried by the open audio device structure and comprising a flat rectangular diaphragm comprising a front face and a rear face, the diaphragm configured to radiate front acoustic radiation from its front face and into a front acoustic volume that has a first sound-emitting outlet and further configured to radiate rear acoustic radiation from its rear face and into a rear acoustic volume that has a second sound-emitting outlet;

wherein the transducer further comprises a primary magnet proximate the rear face of the diaphragm, and a magnetic circuit that defines a path for magnetic flux of the primary magnet, wherein the primary magnet comprises a rear face spaced farthest from the diaphragm, and wherein the magnetic circuit comprises a rear pole piece proximate the rear face of the primary magnet, and wherein the second sound-emitting outlet comprises a first opening in the rear pole piece, wherein the transducer has an area and the first opening comprises at least about 4% of the transducer area.

* * * * *